United States Patent [19]

Madl, Jr.

[11] 4,070,847

[45] Jan. 31, 1978

[54] SPACE FRAME STRUCTURE

[76] Inventor: Joseph Madl, Jr., 990 Volante Drive, Arcadia, Calif. 91006

[21] Appl. No.: 746,967

[22] Filed: Dec. 2, 1976

[51] Int. Cl.[2] ..... E04H 12/10

[52] U.S. Cl. ..... 52/650; 85/1 R; 85/35; 151/41.7; 403/14; 403/171

[58] Field of Search ..... 403/171, 172, 176; 52/648, 650, 81; 151/41.7; 85/1 R, 35 R

[56] References Cited

U.S. PATENT DOCUMENTS

| | | | |
|---|---|---|---|
| 3,270,478 | 9/1966 | Attwood | 52/648 |
| 3,421,280 | 1/1969 | Attwood | 52/648 |
| 3,844,664 | 10/1974 | Hogan | 52/81 |

OTHER PUBLICATIONS

Space Grid Structures by John Borrego, © 1968, by MIT, pp. 100, 101, 30–33, 83, 105, 119.

Designing with Aluminum Extrusions by Reynolds © 1950.

*Primary Examiner*—Ernest R. Purser
*Assistant Examiner*—Henry Raduazo
*Attorney, Agent, or Firm*—Knobbe, Martens, Olson, Hubbard & Bear

[57] ABSTRACT

A modular, symmetrical space frame structure utilized in the construction of special architectural spanning structures comprises standardized component parts made of corrosion resistant aluminum or high-strength plastic composite for preferred exterior application and of steel for interior application - all manufactured to precise dimensional tolerances giving the assembled structure an inherent uniformity in the transfer of tension/compression load factors within the web and chord members. A basic standardized eight-way connector capable of connecting four diagonal web members and four horizontal chord members can be interchangeably installed in both the top and bottom chord assemblies thus minimizing the number of different component parts required to assemble the structure and also resulting in a totally symmetrical design. The length of the component web and chord members and the location of the integral locking devices are maintained to close and uniform tolerances so that the subsequent assembly results in a self-aligning structure requiring no jigs or fixtures. Assembly is a highly repetitive process with a single hand tool locking a single fastener, permitting the employment of relatively unskilled or semi-skilled workmen for its assembly and installation. The basic design allows installation or removal of any component at any location within the space frame structure. Therefore, assembly is not restricted to a progressive installation.

16 Claims, 11 Drawing Figures

FIG. 4.
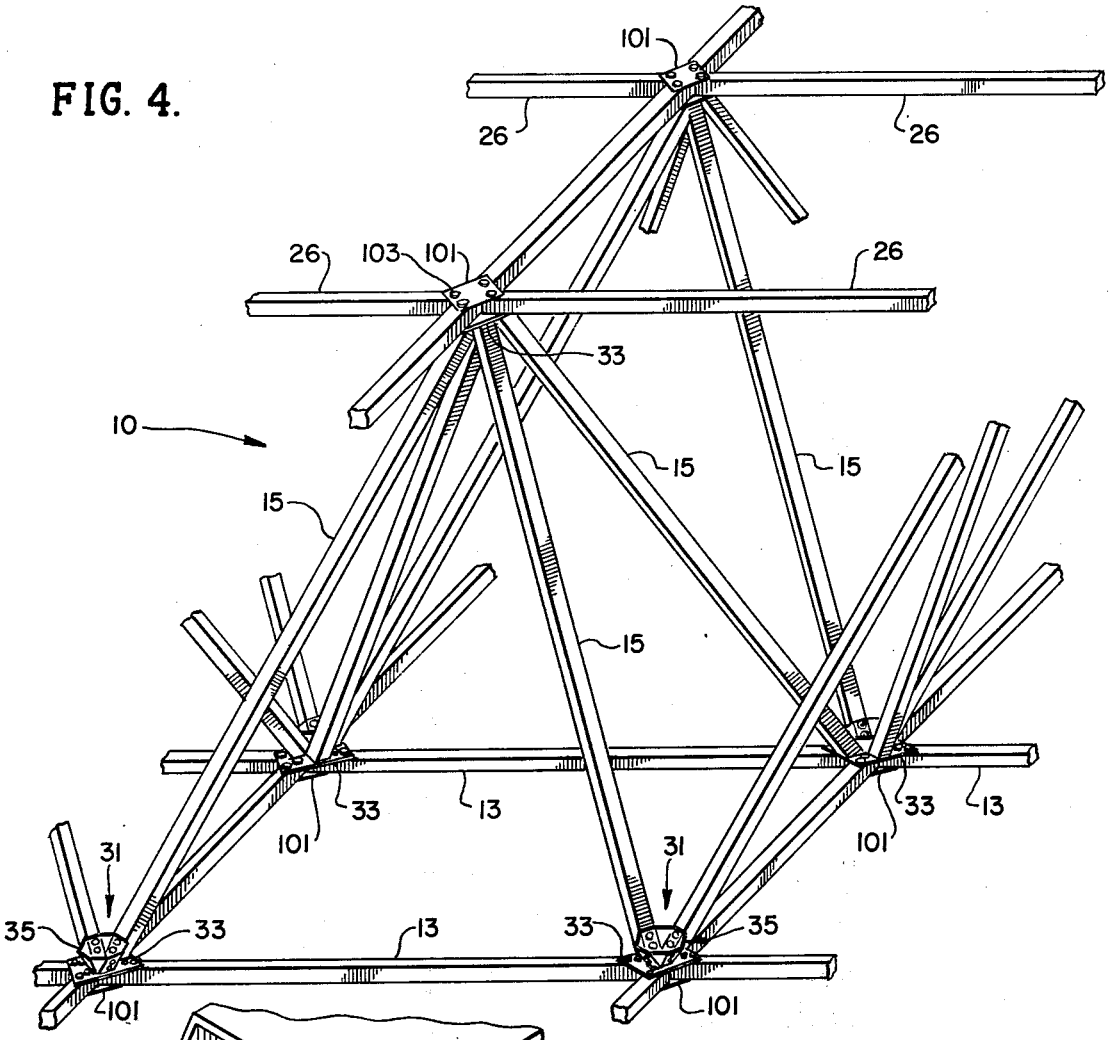
FIG. 8.
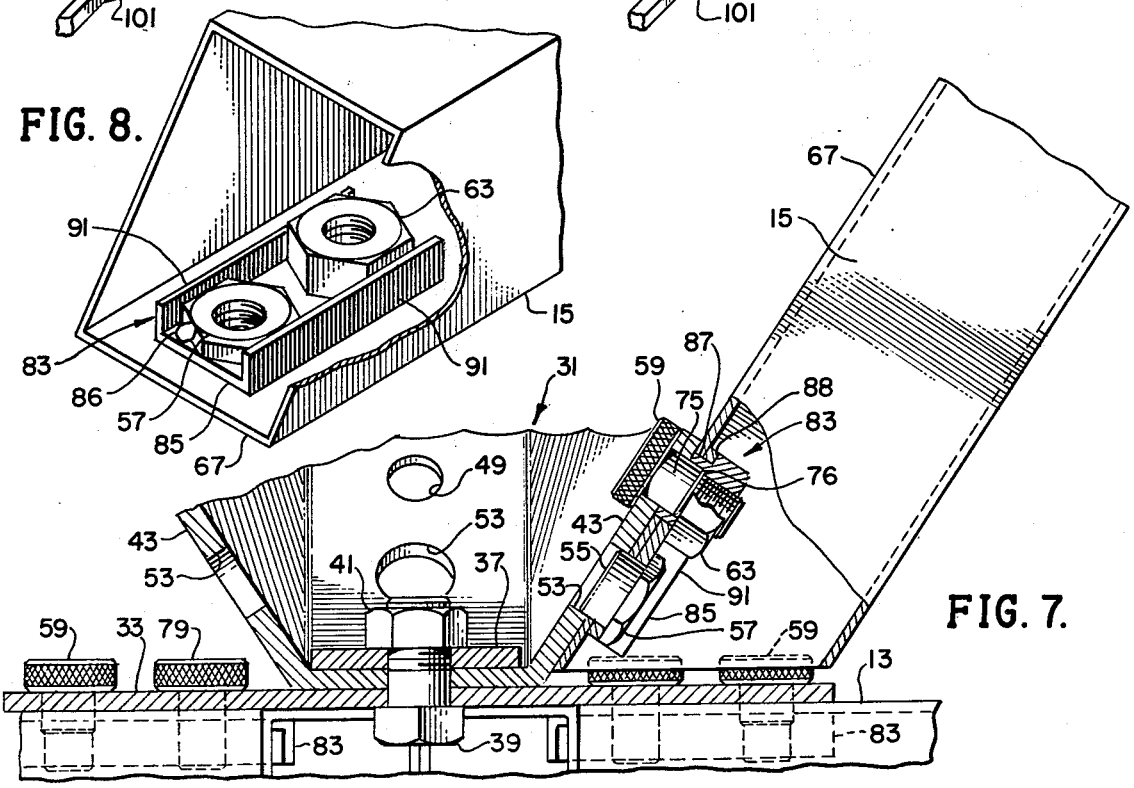
FIG. 7.

SPACE FRAME STRUCTURE

BACKGROUND OF THE INVENTION

In the current state of art for roof span construction, the structural framing systems are usually welded, riveted, or bolted together on the building construction site. Certain truss members may be prefabricated at the factory and delivered to the site by large flat bed trailer trucks. The connecting web members are then individually fabricated or modified to fit at the site as the assembly of the roof truss frame progresses. The need for highly skilled ironworkers and welders is apparent in such a building construction operation. The dimensional tolerances of the end product will vary considerably.

Various concepts and approaches in space frame construction have been developed recently in an attempt to reduce labor costs and to permit rapid and accurate assembly in the field and to develop an end product that is structurally and architecturally uniform and esthetic.

One such prior art concept has been disclosed in the Attwood U.S. Pat. No. 3,270,478 wherein a junction plate or fixture having a combination of planar and angular seats with a plurality of apertures and circular coined projections is used as the connector for channel shaped struts comprising the space frame structure. The struts and fixtures are bolted together by loose hexagon head cap screws and nuts. The assembly operation requires the working of the loose screw and nut in addition to the components to be assembled and in some cases will require more than one tool to perform the proper screw tightening and torquing.

In the Attwood embodiment, each strut is secured to the fixture by a single bolt. In critical locations within the space frame structure where higher tension or compression stresses are encountered, a supplementary member of a different configuration is bolted in parallel to the existing strut under strain. In higher load applications, substantially deeper strut members are used. This design is structurally unsymmetrical since the value of one axis is increased considerably but with relatively little value increase in the other axis.

Since the component parts of the Attwood space frame system are fabricated only from steel, the unfavorable factors of rust corrosion and weight become of primary importance. Also if the system is utilized in an outdoor environment, its periodic maintenance is critical. The tight interlock at bolt connections ordinarily requires reaming of holes after painting or galvanizing thus reducing protection at all points of connection. The U-shaped channel struts comprising the total structure do not lend themselves to easy repainting when the original factory applied protective coating has deteriorated.

The channels used by Attwood provide only one surface for connection to the junction plate. Thus, if one end of the channel strut is on the outside face of the junction plate, the other must be on the inside. This may require different junction plates designs at top and bottom, and in any event results in an unsymetrical assembly.

SUMMARY OF THE INVENTION

The present invention alleviates these and other problems associated with the prior art by utilizing a basic minimum quantity of standardized factory prefinished parts made of high tensile strength aluminum alloy and manufactured to such precise dimensional tolerances that their arrangement within the space frame structure becomes so flexible that the need for identification markings on the individual parts is nullified. The connection points within the lengths of the interconnecting chord and web members are also maintained within tolerances of $\pm 0.005$ of an inch thereby insuring the proper alignment and fitting to the supporting columns, walls, or adjacent structures all of which can be located and constructed to a predetermined dimension in advance.

The preferred embodiment of this invention makes it readily adaptable for various architectural designs of exposed roof span structures, clerestory mall structures, floating roof pavilons, and special geometric structures.

The assembly operation has been simplified to the extent that only one workman can attach by hand the fastening screws connecting the inner web members, the outer chord members, and the connectors. All fasteners within the space frame structure are locked in place by means of a power torque tool with no need for a backup tool or workman.

These and other advantages of the present invention are best understood through a reference to the drawings, in which:

FIG. 4 is a perspective view of a partial section of the assembled space frame structure;

FIG. 7 is a partial sectional view taken along lines 7—7 of FIG. 6;

FIG. 8 is a perspective view of the end of a diagonal web member showing the fixed fastening means;

DETAILED DESCRIPTION OF THE PREFERRED EMBODIMENT

Figure 1:
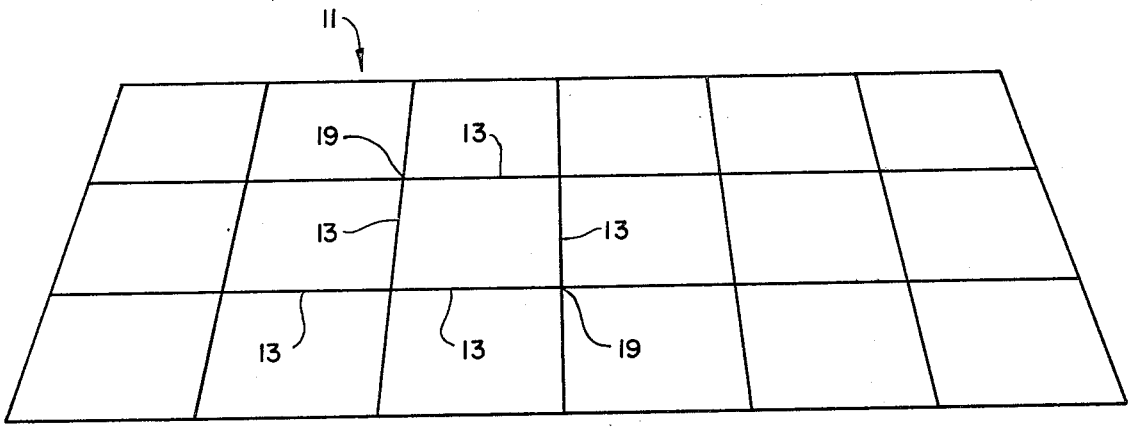
FIG. 1 is a simplified graphic illustration of the lower modular grid structure of a space frame assembly.
Figure 2:
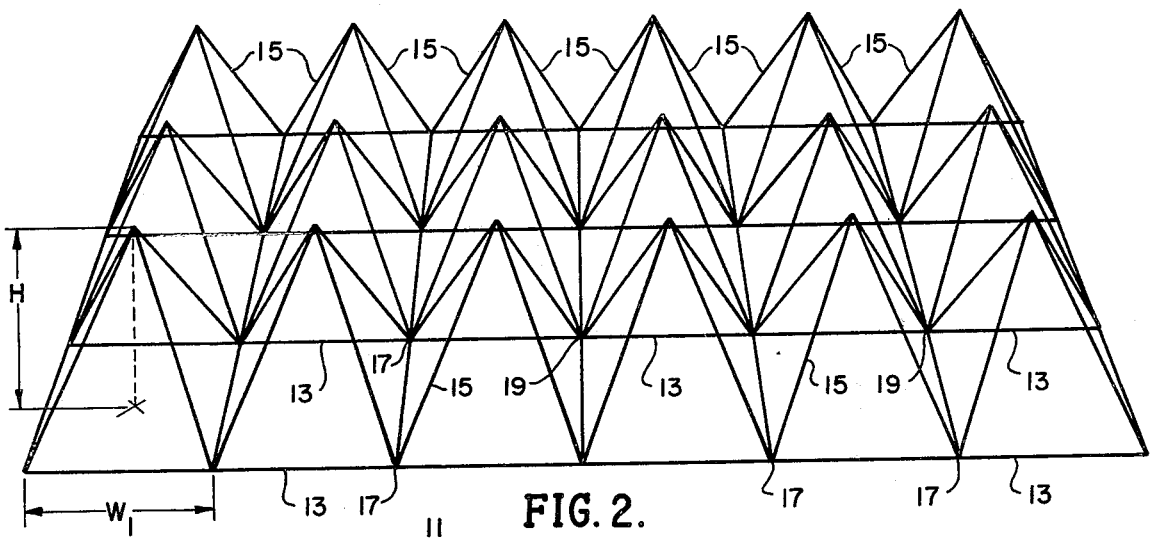
FIG. 2 is a simplified graphic illustration showing the application of the diagonal web members to the lower modular grid structure shown in FIG. 1.
Figure 3:
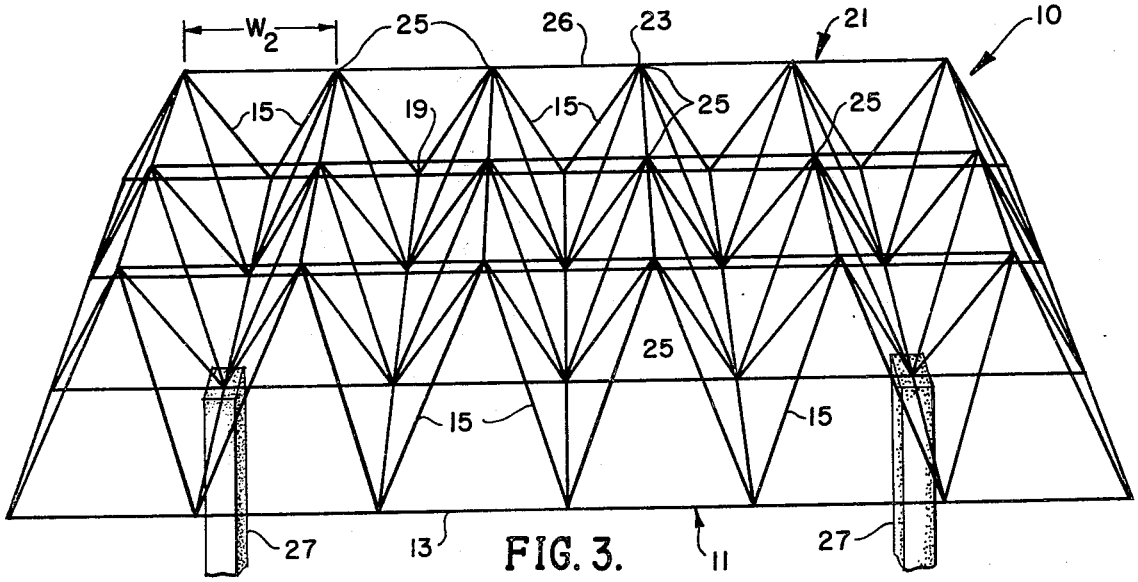
FIG. 3 is a simplified graphic illustration showing in perspective the completed space frame assembly after the application of the top modular grid structure.

FIGS. 1, 2, and 3 graphically illustrate the basic geometric composition of a space frame structure 10.

FIG. 1 shows a segment of the modular lower chord grid structure 11 as it may be partially assembled with web connectors which will be described and shown in detail later. The horizontal chord members 13 comprising the grid structure 11 are of equal length and the ends of which are connected in a square grid pattern.

The second phase of assembly of the space frame structure 10 is illustrated in FIG. 2. The diagonal web members 15 are fixed at their point of convergence at the lower apex 17 to the intersection points 19 of the horizontal chord members 13 comprising the lower modular chord gird structure 11 as was shown in FIG. 1.

The application of the top modular chord grid structure 21 is shown in FIG. 3. The upper points of convergence 23 of the diagonal web members 15 are fixed to the intersection points 25 of the top horizontal chord members 26 comprising the grid structure 21. As viewed from the top, the intersection points 25 of the top grid 21 appear in an offset position to the intersection points 19 of the lower grid 11. When all points of convergence of the web and chord members have been secured, the completed section of the space frame 10 as shown in FIG. 3 is lifted into place by a suitable means such as a crane and secured to the tops of the support columns 27, two of which are only shown of the total skeletal building structure. The unattached edges of the space frame section 10 are held in place by temporary upright braces or scaffolding until an adjacent section of the space frame is assembled, lifted into place and bolted.

The modular concept of the space frame 10 is achieved by having the distances $W_1$ of the lower grid 11, $W_2$ of the top grid 21, and the height H of the pyramidal shape formed by the diagonal web members 15 all equal. By increasing the lengths of the diagonal web and horizontal chord members 15, 13, and 26 respectively, the size of the module can be increased to conform with any architectural requirements within a three to fifteen foot range. The basic connector, to be described in detail hereinafter, is universally used for any size module and will permit the attachment of web and chord members 13, 15, and 26 having larger cross sectional dimensions wherever required within the space frame structure 10.

Referring now to FIG. 4, a partial section of the assembled space frame 10 is shown. The diagonal web members 15 and the upper and lower horizontal chord members 26 and 13 respectively are made of corrosion resistant aluminum of square cross sectional configuration. The square tubular members used in this structure can sustain greater compression and tension load factors for a given amount of weight of material than members made of angle or U-channel configurations. The wall thickness of these members is reduced to minimum acceptable requirements with a resultant decrease of weight of the dead load factor of the assembled structure. The connectors and supplementary fastening means for joining the web and chord members 13, 15, and 26 are also made of corrosion resistant aluminum. Since all of the elements comprising the space frame structure 10 are made of the same weather-proof, corrosion resistant metal, they can be assembled in their raw unfinished state or prefinished at the factory if a particular color or finish is required for aesthetic reasons in the completed structure. An additional advantage for utilizing square cross sectional members is its ability to resist the accumulation of dust, dirt, droppings, and other foreign matter requiring expensive custodial maintenance.

Figure 5:
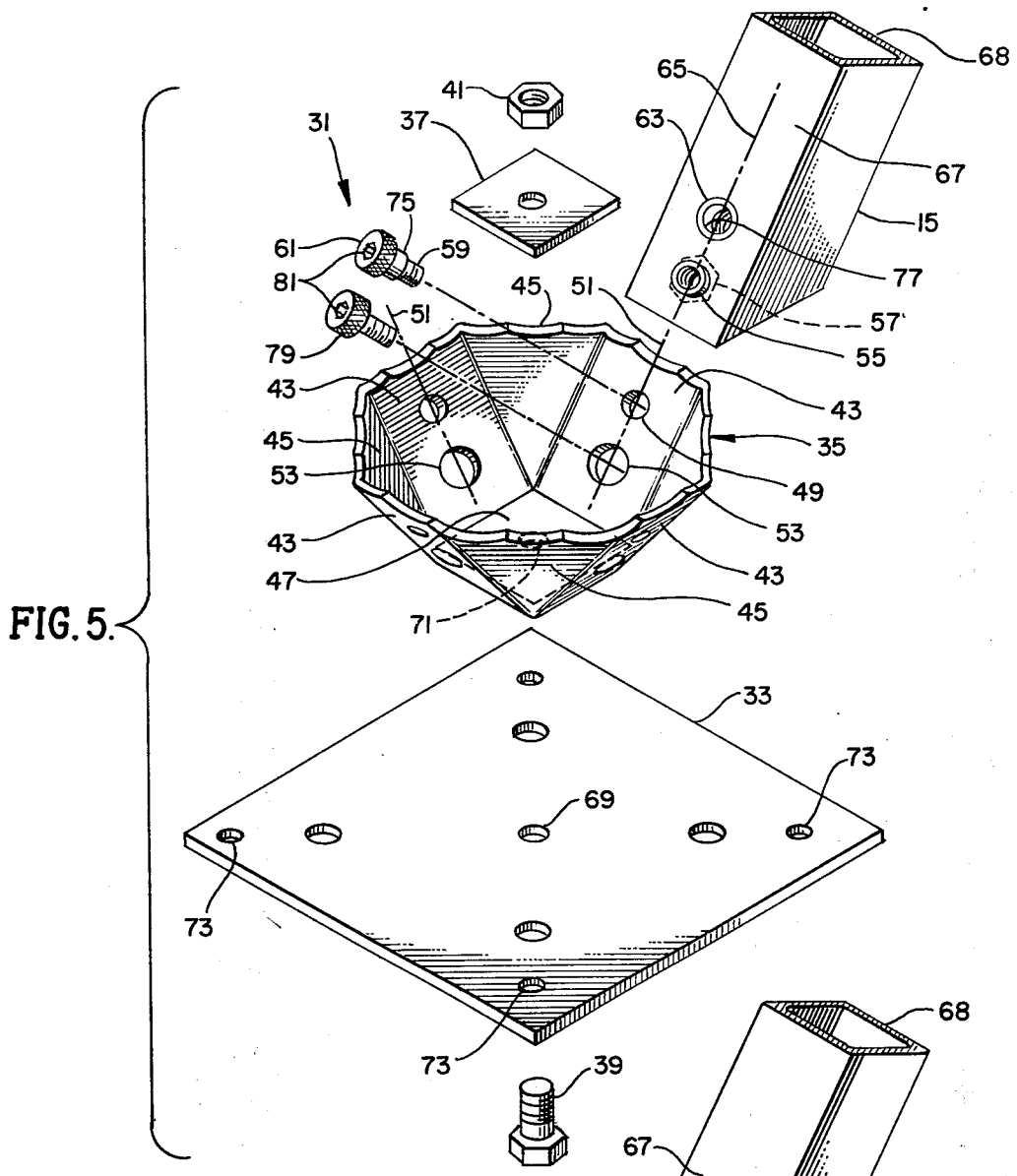
FIG. 5 is a perspective view of the eight-way connector showing its component parts in an exploded or disassembled position.
Figure 6:
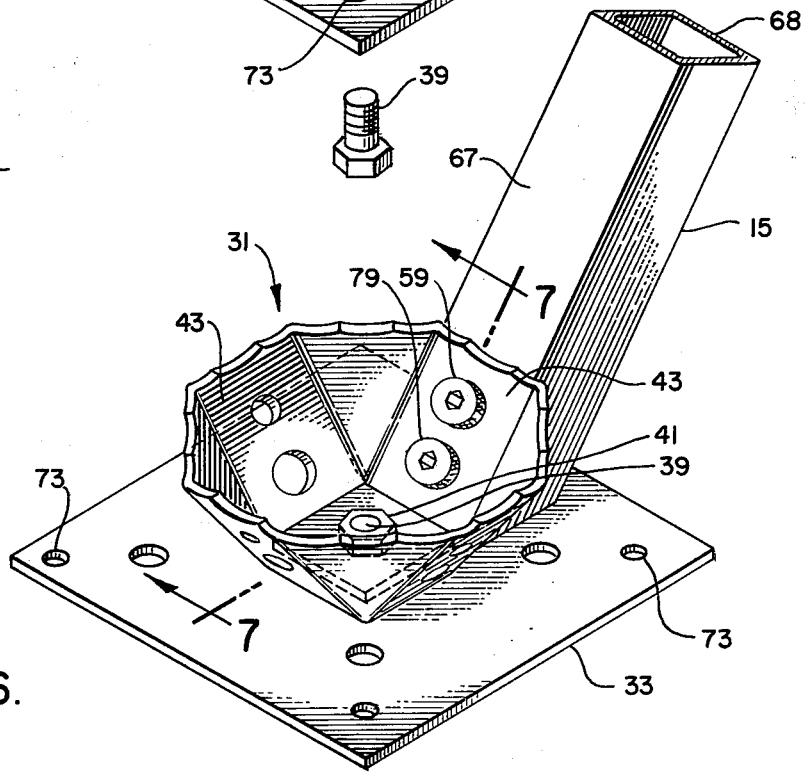
FIG. 6 is a perspective view of the assembled connector with a diagonal web member locked in place by the fastening screws.

Referring now to FIGS. 5 and 6, the universal eight-way web connector 31 is shown in detail with its component parts in an exploded or disassembled position. The basic components comprising the web connector 31 are a square flat base plate 33, a pyramidal shaped web connector 35, an inner square washer 37, and a hexagon head screw 39 with net 41. The web connector 35 has four angular planar surfaces 43 whereon four square tubular members 15 are attached at 90° sectors as viewed from a top plane. It should be noted here, that the web members 15 can be of any size, square or rectangular in cross sectional configuration as the design or load factor dictates, without the alteration or modification of the basic web connector 31. Each of the angular surfaces 43 are connected by reinforcement webs 45 thus forming an inverted truncated pyramidal connector 35. A square planar surface 47 connects the angular surfaces 43 to form an integral cup shape. Thus basically the web connector 35 is drawn from a flat polygonal shaped sheet of aluminum having eight sides to form said cup shape. A plurality of precisely reamed holes 49 are located on the vertical axis 51 of each of the four planar surfaces 43. Second innermost holes 53 also located on the axis 51 are of a larger diameter allowing a projecting collar 55 of hexagon nut 57 as best shown in FIG. 7 to fit snugly within said hole 53.

The knurled socket head cap screw 59 having enlarged knurled head 61 and increased diameter 75 fits snugly through hole 49 in the angular surface 43 of the connector 35 and into a counterbored recess 77 of the anchored nut 63 (best shown in FIG. 7). The tapered shoulder 76 terminating the diameter 75 of the screw 59 seats itself into the end of recess 77 thus accurately positioning the web member 15 between the upper and lower connectors 31 in the space frame structure 10. A second knurled socket head screw 79 extends into the hex nut 57 fixed on the web member 15. Both hexagon nuts 57 and 63 are precisely located on the axis 65 of the mating surface 67 of the square web member 15. Similar fastening means are provided at the opposite end on the opposite mating surface 68. The centerline to centerline dimensions of the apertures in the connectors 31 and the web members 15 are machined under close dimensional tolerances at the factory thereby assuring part interchangeability and ease of assembly in the field.

The square flat base plate 33 is attached to the web connector 35 by means of a screw 39 passing through reamed holes 69 and 71 centrally located in the base plate 33 and square planar surface 47 of the web connector 31 respectively. The two basic components 33 and 35 of the connector 31 are thus precisely aligned and fastened together by the hexagon head screw 39, square washer 37, and hexagon nut 41. The plate also serves to cover the open ends of the web members 15.

A plurality of holes 73 located precisely upon the diagonals of the base plate 33 are used to attach the horizontal chord members 13 and 26 to the underside of plate 33 in the same manner as the diagonal web members 15 are attached to the angular surfaces 43. The distance between holes 73 and the central aperture 69 in the base plate 33 is maintained within a tolerance of $\pm 0.001$ of an inch in order to establish a fitting tolerance of $\pm 0.005$ of an inch between the points of attachment of the space frame segment 10 and the supporting columns 27 as shown in FIG. 3.

Referring now to FIGS. 7 and 8, the web member 15 is shown in partial cross section revealing the inner screw fastening means 83. The screw fastener 83 comprises a U-channel 85 wherein hexagon nuts 57 and 63 are secured in place. The channel 85 with its nuts 57, 63 is attached to the inner side of the mating wall 67 of the square tubular web member 15. The hexagon nut 63 has a cylindrical reduced diameter neck 87 having a press fit tolerance into the web wall 67 to enable said neck 87 with its shoulder 88 to clinch channel 85 to the mating wall 67 of member 15. The second nut 57 having neck 55 fits through channel 85 and wall 67 securing said two members together by a press fit. The nut 57 is also spot welded to channel 85 at 86. Thus the integral fastening means 83 also strengthens the wall sections of the mating surfaces 67 and 68 at the point of connection.

Figure 9:
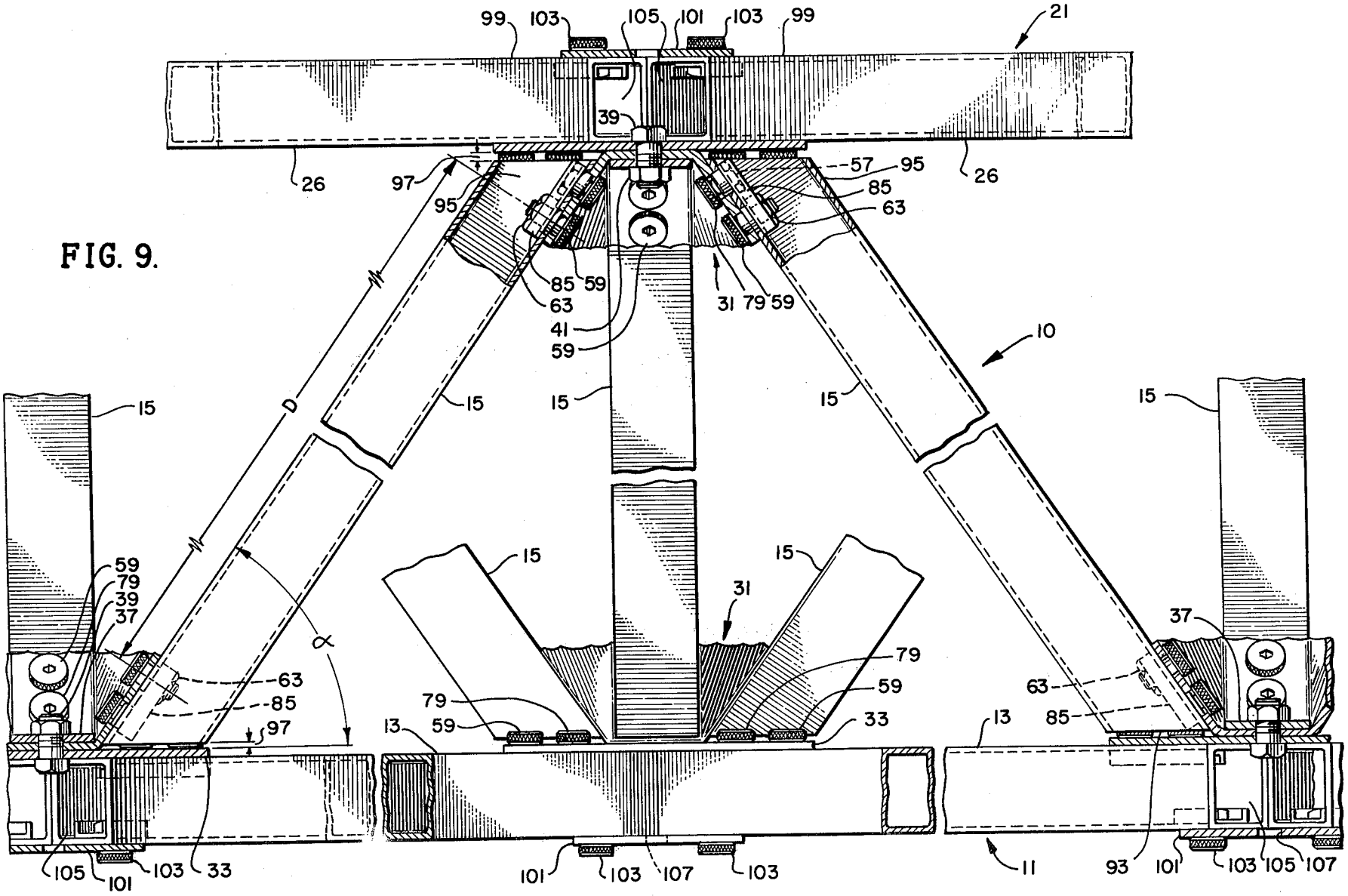
FIG. 9 is a partial sectional view through a segment of the space frame structure showing the upper and lower grid chord members attached to the diagonal web members.

Referring now to FIG. 9, both ends 93 and 95 of web member 15 are cut at an angle equal to the included angle between the angular surface 43 of the connector 35 and the flat base plate 33. This angle has been established at 56° to accommodate the maximum number of modular designs for the space frame structure 10. A clearance 97 is provided between the ends 93 and 95 of the web member 15 and the upper and lower base plates 33 permitting accumulated moisture to drain off at the lower end 93 and air to circulate within the tubular member 15. The clearance 97 at both ends also permits easy insertion of the web member 15 between horizontal grids 21 and 11.

The horizontal chord members 13 and 26 have similar screw fastener means 83 as the diagonal web members 15 internally attached whereby the ends 99 can be fastened to the base plate 33 by means of knurled socket head screws 59 and 79. A square closure plate 101 attached by knurled head socket screws 103 to the outer sides of the ends 99 of the horizontal chord members 13 and 26 seals off the exposed openings 105 of said members. A centrally located aperture 107 in each of the plates 101 is provided for moisture drainage and air circulation throughout the lower and upper grid assemblies 11 and 21.

The assembly of a diagonal web member 15 to the web connector 31 is accomplished readily on the jobsite with only hand tools. Referring to FIG. 6, one end of the web member is placed against an angular surface 43 and the projecting neck 55 inserted in hole 53 to accurately position the web member. The initial fastening screw 59 is engaged by hand by means of its knurled head 61 and threaded into nut 63. As described above, the tapered shoulder 76 (FIG. 7) of the screw 59 seats on the bore wall of the nut 63 as the screw 59 is tightened to precisely position the web member on the connector 31.

The second knurled socket head screw 79 is also engaged and tightened by hand at this stage of the assembly operation. The final tightening of the screws 59 and 79 is accomplished by a power torque tool fitted with a hexagon allen wrench which is inserted into the hexagon socket holes 81 of screws 59, 79. The remaining connections at the opposite end of each diagonal web member 15 and at both ends of the horizontal chord members 13 and 26 are made in the same manner.

The width of the channel 85 between its upright walls 91 is equal to the width across the flats of the hexagon nuts 57 and 63 thus positively preventing their twisting during the assembly operation and alleviating the need of a second hand tool for holding said nuts since the closed configuration of web member 15 precludes the use of same. As previously described, the projecting shoulder 55 of thenut 57 permits the preliminary alignment of the web members 15 as they are hand fitted between the upper and lower connectors 31. A clearance of 0.030 of an inch is incorporated between the shoulder 55 and the reamed hole 53 in the angular side 43 of the web connector 31. A similar tolerance at the opposite end permits the web members 15 to be fitted easily since the distance "D" between the fastening means 83 at each end of said member is held to a minimum tolerance of ±0.005 of an inch. This close dimensional tolerance also permits the interchangeability of the web members 15 throughout the space frame structure 10 thus negating the need for individual part identification. As clearly shown in FIG. 7, any shear force generated between the mating surface 67 and the angular surface 43 acts upon the larger diameter 75 of screw 59 and the projecting collar 55 of the fastening nut 57. Thus the increased diameter of these fastening members has a distinct shear stress advantage over conventional fastening screws.

Figure 10:
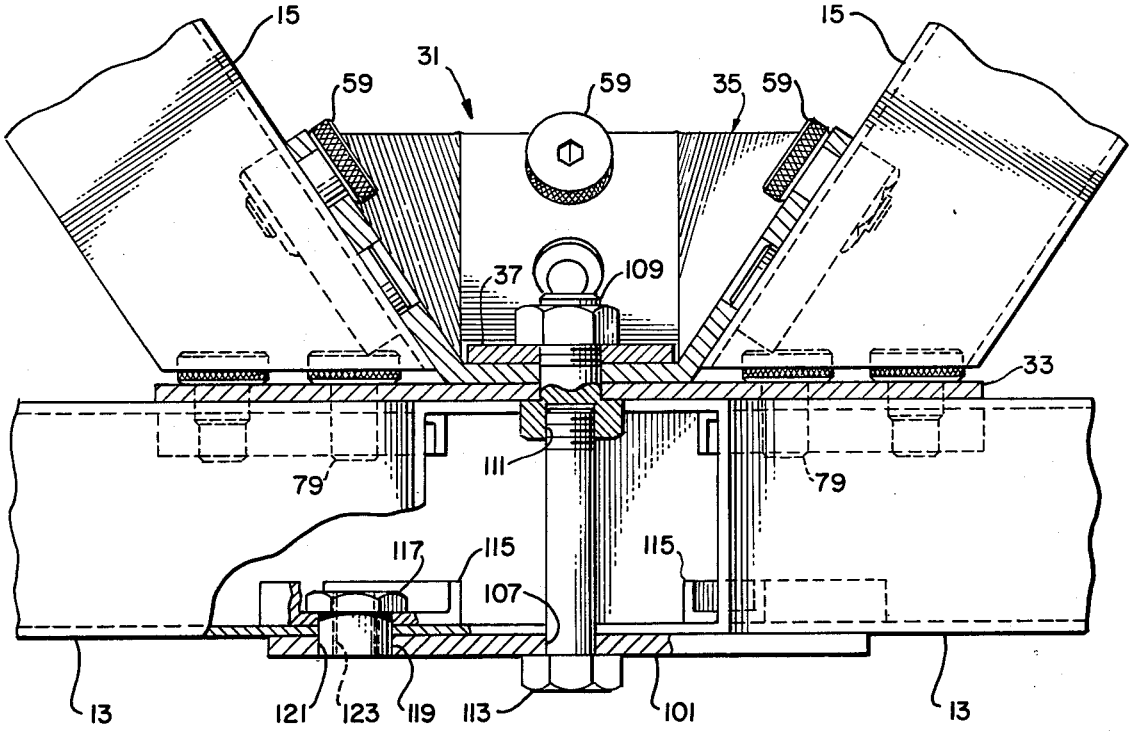
FIG. 10 is a partial sectional view showing an alternate embodiment of the assembly of the eight way connector.

Referring now to FIG. 10, an alternate embodiment of the assembly of the eight-way web connector 31 is shown. The hexagon head screw 109 joining together the square washer 37, the base plate 33, and the web connector 35, has a threaded aperture 111 in its head wherein a long connector 113 is fastened. The bolt 113 passes through an aperture 107 of a closure plate 101 thus securing said plate 101 to the web connector 31. The horizontal chord members 13 are provided with reinforcement channels 115 wherein an elongated nut 117 is press fitted. The nut 117 has a round tubular section 119 which fits into apertures 121 precisely located in the closure plate 101. The elongated nut 117 is threaded at 123 for engagement of a knurled screw 79. The function of the plate 101 is esthetic in covering the junction point of the chord members 13, and also resists shear and torsion.

Figure 11:
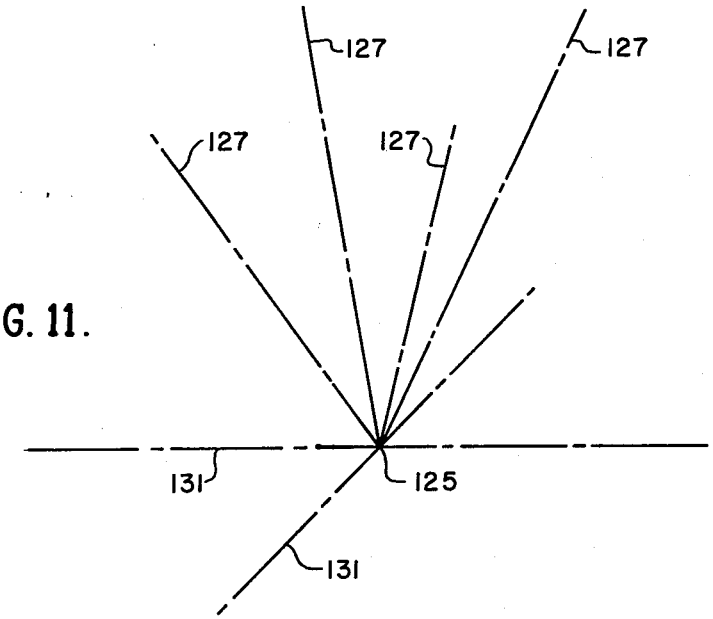
FIG. 11 is a diagram showing the point of convergence of the center lines of the web and chord members.

FIG. 11 illustrates the ideal situation wherein the working center lines 127 of the diagonal web members 15 and the working center lines 131 of the horizontal chord member 13 intersect at a common point 125 for maximum strength; the working center line being the axis about which the stress in the member is centered. The structure of this invention very nearly achieves this ideal. The projection of the center lines of alternate sizes for tubular web members 15 would always intersect in close proximity to the working line 131 of the chord members 13, thus maintaining the structural strength of the composite space frame structure 10.

In summary there has been described a space frame structure utilizing square tubular web and chord members, a standardized eight-way connector, and large knurled head fastening screws which permit easy preliminary assembly by hand of the dismantled factory delivered component parts. All of said component members are factory prefinished and made of high tensile strength aluminum alloy and manufactured to such precise dimensional tolerances that said members can be randomly installed or replaced within the space frame structure nullifying the need for part identification, preselection, or modification for fitting. The standardized eight-way connector is universally adaptable for installation in both the upper and lower modular grid assemblies without modification. The diagonal square tubular web members having duplicate fastening means installed on opposite mating sides permit the use of an identical connector at both ends.

Another advantageous feature of the present invention is realized in the architectural applications requiring the geometric modular structure to be exposed. Since the fastening means contained within the web members are hidden and all exposed fastening screws have pleasing round knurled heads, the aesthetic quality of the assembled truss structure is greatly enhanced.

While the illustrated embodiment shows a single tiered space frame, the modular concept of this invention permits construction of unusual and varied configurations using standard components. For example, multiple tiers can be incorporated for additional spanning capability and special architectural effect.

In addition to the support columns illustrated as holding the space frame, other means of support can be used such as perimeter walls on ledges.

Preferably all the web members are identical and all of the chord members are identical for interchangeability, but the web members need not be identical in cross-sectional size to the chord members. For example, ordinarily the diagonal web members have less stress and thus can be smaller than the horizontal chord members. The unique connector of this invention permits such variation as cross-sectional size, while still using the standard connector.

Because the open ends of the web members are covered by a plate, reinforcement can be concealed inside the web members if needed, without detracting from the uniform esthetic appearance.

Although particular embodiments of the invention have been described and illustrated herein, it is recognized that modifications and variations may readily occur to those skilled in the art and consequently it is intended that the claims be interpreted to cover such modifications and equivalents.

The wall 67 of the web members and the corresponding wall of the chord members may be designed to be quite thin, because the points of connection, which are critical stress areas, are reinforced by the use of an oversize hole into which the neck on the nut is press fit, the nut adding reinforcing.

I claim:

1. A modular space frame structure comprising:

a bottom horizontal modular chord structure having a plurality of chord members connected at their ends forming a grid pattern;

a top horizontal modular chord structure having a grid pattern offset from said bottom grid pattern so that the intersections of the top grid are directly over the centers of the openings in the bottom grid;

an intermediate truss structure connected between said bottom and top chord structures having a plurality of diagonal web members each connected from an intersection of the bottom chord members to an intersection of the top chord members; and a connector at each said intersection for interconnecting said chord members and web members;

said connector including a cup shaped member having four inclined flat sides each extending along one of said diagonal web members;

threaded means connecting each of said flat sides to its related web member;

reinforcing means connected between adjacent flat sides but not extending outward beyond the planes of said flat sides; and each said diagonal web member being connected to a top connector on one face of said web member and to a bottom connector on the opposite face thereof so that the top and bottom connections are the same but inverted.

2. The structure of claim 1 wherein:

each of said flat sides is rectangular;

each of said reinforcing means is triangular;

the bottom edges of said flat sides are interconnected by a square bottom; and said flat sided, reinforcing means and square bottom are all integrally formed of a single piece.

3. A structure in accordance with claim 1 wherein said connector further comprises:

a flat plate separate from said cup-shaped member and disposed between said cup-shaped member and said chord members;

threaded means connecting said flat plate to each of four chord members intersecting at said connector; and threaded means connecting said cup-shaped member to said flat plate.

4. A structure in accordance with claim 1 wherein said chord and web members are tubes of rectangular cross-section.

5. A structure in accordance with claim 4 and further comprising:

two holes through each of said flat sides of the connector;

two threaded nuts fixed to each end of each said web member and precisely aligned with said two holes; and one of said threaded nuts having a neck portion protruding from said web member into one of said holes and fitting snugly therein for initial alignment in assembly, and for adding shear and torsion resistance to supplement that of the other nut connection.

6. A structure in accordance with claim 5 and further comprising:

a seat formed around the threaded bore of the other one of said nuts;

a screw for fastening said connector to said other nut having a tapered shoulder which seats on the seat of said nut to precisely align said connector relative to said web member.

7. A structure in accordance with claim 5 and further comprising:

two screws engaged in said two nuts for connecting said connector to said web, each of said screws having a large knurled head facilitating hand-tightening.

8. A structure in accordance with claim 5 wherein each of said horizontal chord members includes two threaded nuts on each end like those on the ends of the web members, and further comprising:

a flat plate separate from said cup-shaped members and disposed between each said cup-shaped member and its associated chord members, said plate having four pairs of holes therein each like the pair of holes in the flat side of the cup-shaped member.

9. A structure in accordance with claim 4 wherein both ends of said web members are mitered to be generally horizontal.

10. A structure in accordance with claim 3 and further comprising:

a second flat plate on the opposite side of said chords from said first flat plate, and covering the intersection of said chords, and adding shear and torsion resistance.

11. A structure in accordance with claim 1 wherein said chords, web members, and connectors are fabricated of aluminum.

12. A structure in accordance with claim 1 wherein each of said chord members are of the same dimensions.

13. A structure in accordance with claim 1 wherein each of said chord members is of the same length which length is equal to the vertical dimension from the bottom grid to the top grid.

14. A modular space frame structure comprising:

a bottom horizontal modular chord structure having a plurality of chord members connected at their ends forming a grid pattern;

a top horizontal modular chord structure having a plurality of chord members connected at their ends forming a grid pattern offset from said bottom grid pattern so that the intersections of the top grid are directly over the centers of the openings in the bottom grid;

an intermediate truss structure connected between said bottom and top chord structures having a plurality diagonal web members of each connected from an intersection of the bottom chord members to an intersection of the top chord members; and a connector at each said intersection for interconnecting said chord members and web members;

said connector including a cup-shaped member having four inclined flat sides extending along one of said diagonal web members and each having two holes therethrough;

two nuts fixed to each end of each said web member and precisely aligned with said two holes;

one of said nuts having a neck portion protruding from said web member into one of said holes and fitting snugly therein for initial alignment in assembly, and for adding shear and torsion resistance to supplement that of the other nut connection;

the clearance between said neck and its mating hole being about 0.030 inch;

the other of said nuts being threaded and the distance between said threaded nuts at opposite ends being maintained within a tolerance of about ±0.005 inch; and a threaded bolt extending through the other of said holes and threaded into said threaded nut, said bolt having a stepped diameter with a tapered shoulder which seats on said nut to precisely position the web member on the connector.

15. A modular space frame structure as defined in claim 14 and further comprising:

each of said horizontal chord members including two nuts on each end like those on the ends of the web members;

a flat plate separate from said cup-shaped members and disposed between each said cup-shaped member and its associated chord members, said plate having four pairs of holes therein each like the pair of holes in the flat side of the cup-shaped member; and the dimension from the center of said flat plate to the outermost hole in each of said pair being maintained within a tolerance of about ±0.001; and the distance between the innermost nut at the opposite ends of each chord being maintained within a tolerance of about ±0.005.

16. A modular space frame as defined in claim 14 and further comprising:

each said web members having a thin-walled side abutting the connector;

said thin-walled side being too thin to transfer the stress from the member to the connector at the point of connection under design load, a pair of holes through each end of said thin-wall; and a neck portion on each said nut press fit into said hole, said nut providing sufficient reinforcing to said thin wall to transfer said stress under design load.

* * * * *